United States Patent [19]

Williams

[11] Patent Number: 4,953,241

[45] Date of Patent: Sep. 4, 1990

[54] BATHTUB WITH DOOR FOR EASY ACCESS

[76] Inventor: Douglas P. Williams, 4 Dussault Drive, Latham, N.Y. 12110

[21] Appl. No.: 292,395

[22] Filed: Dec. 30, 1988

[51] Int. Cl.[5] ..... A47K 3/02

[52] U.S. Cl. ..... 4/556; 4/579; 4/590; 49/250; 49/252

[58] Field of Search ..... 4/555, 556, 584, 607, 4/604, 611, 579, 578; 49/250 X, 252 X, 253

[56] References Cited

U.S. PATENT DOCUMENTS

| | | | |
|---|---|---|---|
| D. 285,346 | 8/1986 | Sween | 4/555 |
| 1,055,304 | 3/1913 | Faye | 49/252 |
| 2,714,725 | 8/1955 | Boone | 4/148 |
| 3,066,316 | 12/1962 | Russell | 4/173 |
| 3,371,354 | 3/1968 | Hayslett | 4/173 |
| 3,380,078 | 4/1968 | Hanson | 4/173 |
| 3,663,971 | 5/1972 | Bonhote | 4/173 |
| 3,719,960 | 3/1973 | Russell | 4/173 |
| 3,863,275 | 2/1975 | Brendgord et al. | 4/173 |
| 4,089,135 | 5/1978 | Beny et al. | 4/607 |
| 4,118,810 | 10/1978 | Brickhouse et al. | 4/173 R |
| 4,360,935 | 11/1982 | Barrett, Sr. | 4/555 |
| 4,365,367 | 12/1982 | Houle | 4/555 |
| 4,491,990 | 1/1985 | Robinson et al. | 4/607 |
| 4,542,545 | 9/1985 | Johnson et al. | 4/555 |
| 4,583,251 | 4/1986 | Fürst et al. | 4/555 |
| 4,598,433 | 7/1986 | Whitney | 4/607 |
| 4,754,997 | 7/1988 | Thompson-Ashworth | 49/250 |

FOREIGN PATENT DOCUMENTS

| | | | |
|---|---|---|---|
| 3047509 | 7/1982 | Fed. Rep. of Germany | 4/611 |
| 2502678 | 10/1982 | France | 4/607 |
| 452679 | 8/1936 | United Kingdom | 49/253 |
| 775001 | 5/1957 | United Kingdom | 4/611 |

*Primary Examiner*—Henry J. Recla
*Assistant Examiner*—Edward C. Donovan
*Attorney, Agent, or Firm*—Heslin & Rothenberg

[57] ABSTRACT

An improved bathtub with a door for easy access by older and physically handicapped persons is disclosed. The bathtub includes an entrance wall with an opening which conforms to the shape of the door, and a front wall adjacent to the entrance wall. A seat is located in the tub with the forward edge of the seat located so as to provide a leg space between the seat and the front wall of the tub. The front edge of the door is attached adjacent to the front wall of the bathtub by means of a double axis hinge. When the door is opened, its front edge is guided directly inwardly in the tub by means of a tracking mechanism and the rear edge moves forward without any significant inward movement. In the fully opened position, the door is parallel to the front wall. The door is so configured that during movement it does not swing over the seat, and an occupant of the tub can be seated while the door is moved between its closed and open positions. The door contains a locking mechanism which can secure the door in a closed position. The door can also be secured in an open position, providing stable support for a person entering and leaving the bathtub.

15 Claims, 3 Drawing Sheets

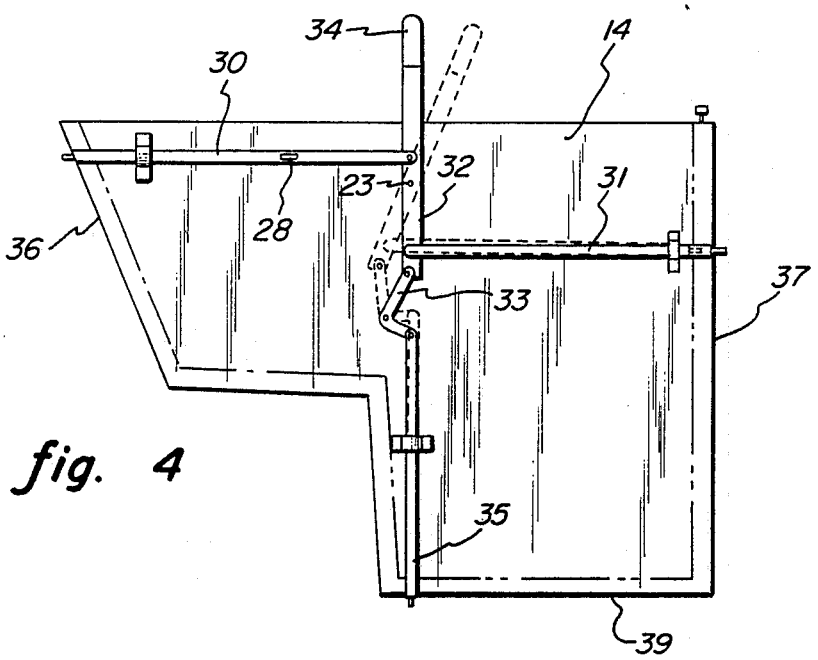
fig. 4
fig. 5
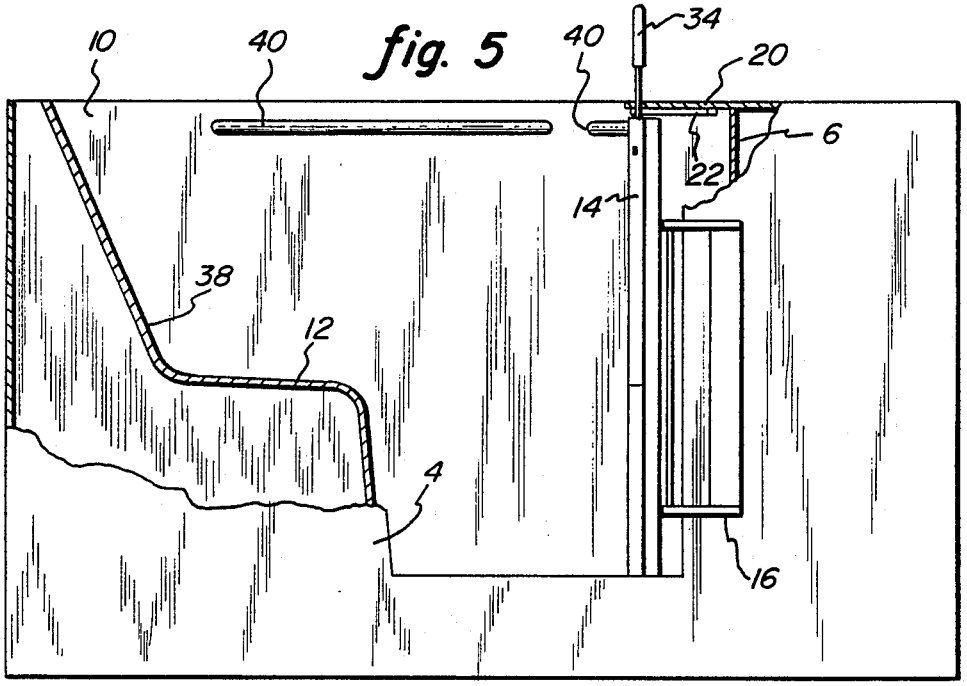

BATHTUB WITH DOOR FOR EASY ACCESS

BACKGROUND

This invention relates generally to bathtubs for older and physically handicapped persons and more particularly, to bathtubs accessible from a seated position by means of a door in the side wall of the tub.

Elderly persons, physically handicapped persons and persons recovering from illness often cannot use a standard bathtub without assistance, and they may be unable to sit inside the bathtub once they gain access because of the shape and contours of the tub. Exiting from the tub may also prove difficult and uncomfortable even with assistance.

Several types of bathtubs have been designed for use by elderly and handicapped persons. In some designs access is gained through doors in the side wall of the tub. In others, the seated bather is lowered into the tub and remains in the seat during bathing, or is positioned in a tub with a raised side wall which is then lowered to enclose the tub. Some of the designs are not suited for use in the home, and many require at least one attendant to aid the bather in entering and leaving the tub.

A bathtub for use in a private home should be of standard size and dimension so as to minimize the need for alterations to an existing bathroom. Examples of patents which disclose tubs suitable for home use are U.S. Pat. Nos. 3,380,O78, 3,719,960, 4,360,935, and 4,583,251. These patents disclose bathtubs with hinged doors which open outwardly or inwardly, a door which slides into an opening in the side wall and can be removed when the tub is not in use, and a door which slides into a space below the tub. Although intended for use by elderly or handicapped persons, these designs have some disadvantages. The disadvantages of an outwardly opening door include leakage due to water pressure, lack of stability and/or support for a bather entering and leaving the tub, the need for additional space in the room to accommodate the door, and the lack of ease in closing the tub door when an unattended bather is seated in the tub. Disadvantages of an inwardly opening door include lack of stability and interference with the safe egress from the tub. Lifting a door out of the side wall may require more strength and dexterity than persons for whom such tubs are designed possess.

BRIEF DESCRIPTION OF THE INVENTION

A principle object of the present invention is to provide a bathtub for the home capable of easy ingress, egress and use by an unassisted elderly or handicapped person.

Another object of the present invention is to provide a bathtub with a side wall door which can be secured in an open position to provide support for the bather while entering and leaving the tub.

Yet another object of the present invention is to provide a bathtub which can be fitted into the space of a standard home bathtub and which does not require additional space for the door to open.

Still another object of the present invention is to provide a bathtub which has a side wall door that is moveable between an opened and closed position with minimal effort on the part of a bather seated in the tub.

A further object of the present invention is to provide a bathtub which is accessible to and usable by an unassisted person who is confined to a wheelchair.

The present invention satisfies these objects by providing a bathtub with a horizontal floor and walls rising upwardly from the floor including an entrance wall and a forward wall. A seat is located in the tub with the forward edge of the seat located so as to provide a leg space between the seat and the forward wall. The entrance wall includes an opening which conforms to the shape of the door. The door has a rearward edge near the seat and a forward edge which is attached adjacent to the forward wall. In the closed position, the door forms part of the entrance wall and in the open position the door is substantially parallel to the forward wall and closely adjacent to it. When the door is opened, its front edge moves directly inwardly along the front wall, while its rearward edge moves forwardly without any substantial inward movement. The door can be operated between the closed and open position by an occupant sitting on the seat inside the tub.

BRIEF DESCRIPTION OF THE DRAWINGS

FIG. 4 is a side elevation of the door with its outer surface removed illustrating the two positions of the linkage lever and rods.

FIG. 5 is a side elevation of the tub with parts of the entrance wall cut away to illustrate the seat structure and the position of the open door relative to the track.

DETAILED DESCRIPTION OF THE INVENTION

Figure 1:
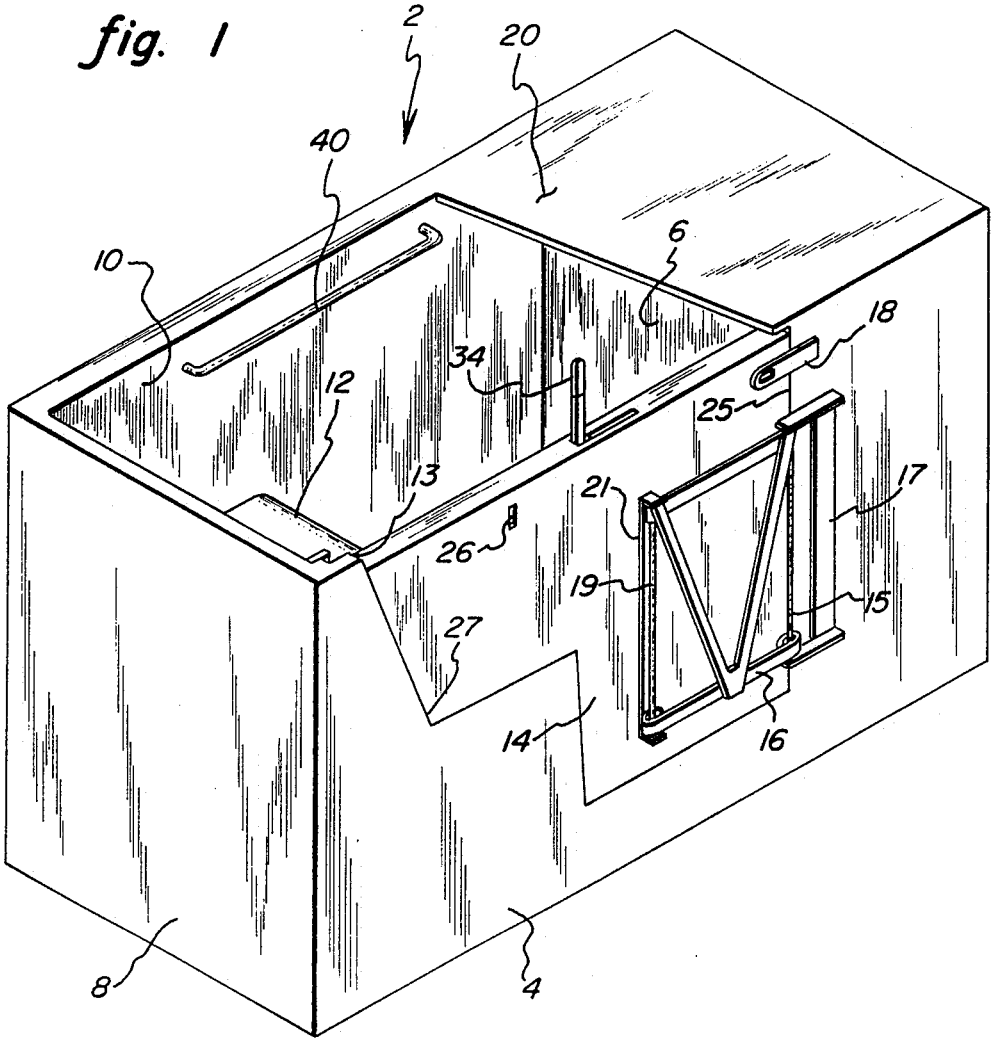
FIG. 1 is a perspective view of the tub with door in a closed position showing the exterior surface of the door, and illustrating the hinge which secures the door to the tub.

Referring to FIG. 1, the bathtub 2 includes an entrance wall 4, a forward-wall 6, a back wall 8 and a side wall 10. A seat 12 is adjacent to entrance wall 4. A door jamb 13 located in the margins of the opening in entrance wall 4 corresponds to the shape of door 14. Door 14 is secured to the entrance wall 4 by a double axis hinge 16. One axis 15 of double axis hinge 16 is rigidly mounted on a bracket 17 which, in turn, is rigidly mounted on an immovable part of entrance wall 4 adjacent to door 14. A second axis 19 is rigidly mounted on a bracket 21 which, in turn, is rigidly mounted in a median area of door 14. As will be apparent from the following description, axis 15 is stationary and axis 19 moves with the door 14. An apertured arm 18 protrudes horizontally into the opening in the entrance wall. A drip cover 20 extends from the forward wall 6. Gaskets are mounted on either the door 14 or jamb 13 in the conventional way, but, for the sake of simplicity are not illustrated. Persons skilled in the art will be familiar with the correct placing of the gaskets.

Figure 2:
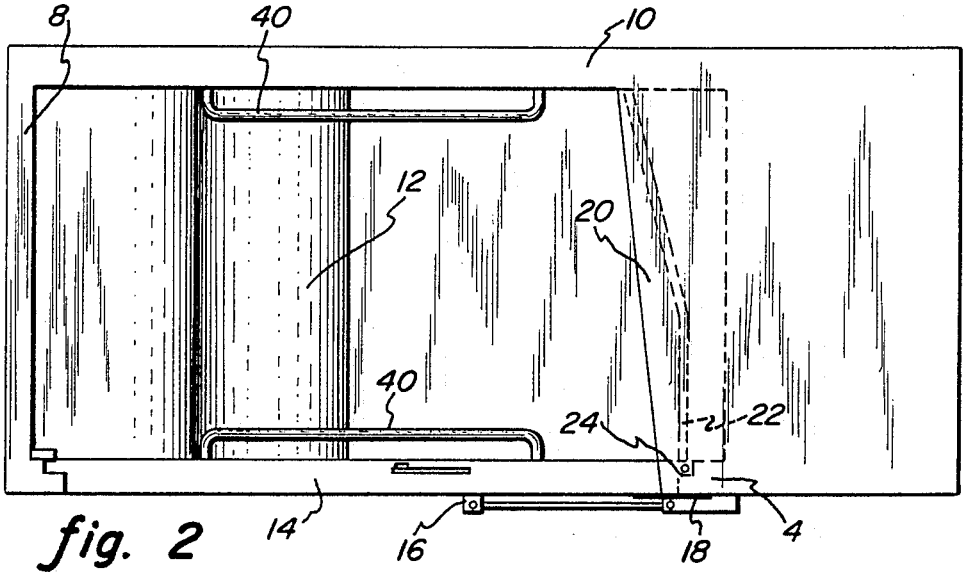
FIG. 2 is a top plan view of the tub with the door in a closed position, illustrating the curved track under the drip cover.
Figure 3:
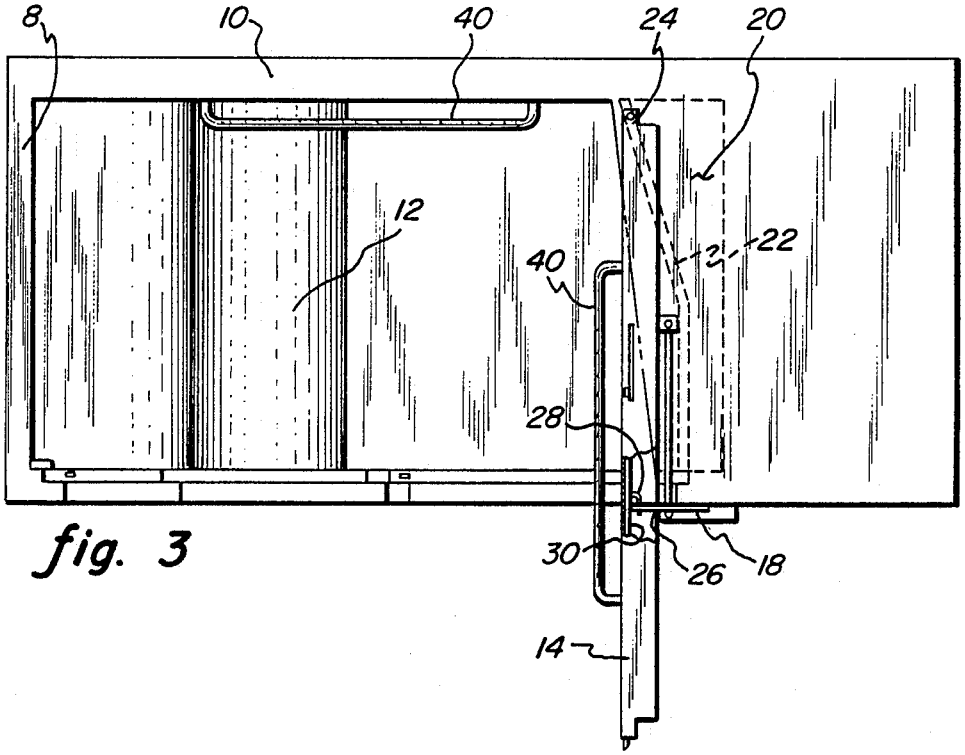
FIG. 3 is a top plan view of the tub with the door in a fully opened position and secured in place by the apertured arm engaged by the hook in the door.

Referring to FIGS. 2 and 3, it may be seen that a track 22 (shown in phantom) is attached to the underside of drip cover 20. A tracking wheel 24 mounted on the upper surface of door 14 is engaged by the track. FIG. 2 illustrates the door in the closed position. The tracking wheel 24 is positioned in the end of the track near the entrance wall 4. When the door is fully open, as illustrated by FIG. 3, the tracking wheel is located in the end of the track 22 adjacent to the side wall 10. It will be understood that the tracking wheel 24 is captured within track 22 so that it can move only from one end of track 22 to the other. This restriction on the movement of tracking wheel 24 and the action of double axis hinge 16 serve to guide the movement of door 14 so that its forward edge 25 moves directly inwardly of tub 2 when the door is operated from its closed to its open position. At the same time, rearward edge 27 of door 14 moves forwardly without any significant inward movement. Thus, the restrictions on the movement of tracking wheel 24 and the action of double axis hinge 16 serve to guide the movement of door 14 in such a way that it does not swing over seat 12. Thus, an occupant of tub 2 can be seated on seat 12 while door 14 is operated between its closed and open positions. The described mechanisms and resulting motion of door 14 form an important aspect of the subject invention.

When the door is locked in the open position, the arm 18 extends into the door 14 through opening 26 (see FIG. 1) and is engaged by a hook 28 attached to a rod 30, all as more fully explained below. The locking mechanism which is located inside the hollow door is more fully illustrated in FIG. 4. A linkage lever 32 is pivotally mounted on door 14 and axle 23 and is pivotally connected to rods 30 and 31. The linkage lever 32 is also connected to linkage arm 33 which is pivotally connected to a third rod 35. The linkage arm 33 forms a 90° angle, the apex of which is pivotally secured to the door. The linkage lever 32 extends vertically through the upper edge of the door 14 to form a handle 34. FIG. 4 illustrates the two positions of the door locking mechanism, with the unlocked position shown in phantom. When handle 34 is moved from the unlocked to the locked position, the linkage lever 32 moves rods 30 and 31 laterally so that the opposite ends of the rods protrude from the forward and rearward edges 36 and 37 of the door. At the same time, linkage arm 33 pivots and moves rod 35 in a downward position so that the end of rod 35 extends through the lower edge 39 of door 14. Sockets to receive the ends of rods 30, 31 and 35 are located in the margins of the door opening in entrance wall 4. The sockets (not shown) can be so shaped that the door is cammed into tight engagement with jamb 13 when handle 14 is moved to the locked position. Also, it will be noted that rod 30 includes a hook 28 for engaging an aperture in arm 18 which protrudes through opening 26 when door 14 is in the fully opened position. It will be understood that hook 28 is so located on rod 30 that it will move into the locking position shown in FIG. 3 wherein hook 28 engages the aperture in arm 18.

FIG. 5 illustrates a view of the tub from the entrance side with the door in the open position and entrance wall 4 partially cut away to reveal the track 22 attached to the lower surface of drip cover 20, which extends from forward wall 6. The entrance wall is also cut away to reveal the seat 12 and backrest 38. Hand grips 40 are attached to the side wall 10 and the inner surface of the door 14. The tub is preferably fabricated of molded acrylic.

It will be appreciated by those skilled in the art that various modifications can be made to the above described embodiment of this invention without departing from the essential nature thereof. It is intended to encompass all such changes within the scope of the appended claims.

What is claimed is:

1. A bathtub easily and safely accessible from a sitting position comprising:

an upwardly opening enclosure having a substantially horizontal floor and having walls rising upwardly from the floor, including an entrance wall and a forward wall transversely adjoining same;

a seat member having a seating surface with a forward edge and an entrance edge, said seat being mounted substantially horizontally within said enclosure above the level of the floor with its forward edge spaced apart from the forward wall so as to define a leg space therebetween and having its entrance edge adjacent the entrance wall;

said entrance wall defining an entrance opening having a door mounted therein, said door having a forward edge on its one end adjacent the adjoinment of said wall with the forward wall and a rearward edge on its other end, said door being operable between a closed position in which it forms a watertight seal with said entrance opening and an opened position in which it is substantially parallel to the forward wall and closely adjacent thereto, said door being configured to fit said opening and said opening being defined by a jamb running, at least in part, along the entrance edge of the seat and along the floor so as to provide said opening into the space over the seat and into the leg space; and means defining the movement of the door so that, in operating from its closed to its opened position, its forward edge moves directly inwardly along the front wall while its rearwardly edge moves forwardly without any substantial inward movement, whereby said door can be operated between its opened and closed positions while an occupant is seated on the seat member adjacent its entrance edge.

2. The tub of claim 1 wherein the front edge of said door is hingably attached to the entrance wall.

3. The tub of claim 2 wherein said hinge is a double axis hinge, one axis being stationary and the other movable with the door.

4. The tub of claim 2 wherein said door can be secured in the closed position by a locking means.

5. The tub of claim 4 wherein said locking means comprises a linkage lever movable between a locked and unlocked position to which a plurality of rods are pivotally connected such that when the door is closed and the lever is moved to the locked position the rods protrude from the forward and rearward edges of the door into the door jamb.

6. The tub of claim 5 wherein said linkage lever extends vertically through an opening in the upper edge of the door forming a handle.

7. The tub of claim 2 wherein said door can be secured in the open position by a locking means.

8. The tub of claim 7 wherein said locking means comprises a linkage lever movable between a locked and unlocked position to which at least one rod is pivotally connected and an arm attached to the front opening of the entrance wall, said linkage lever engaging said arm when the door is open and the linkage lever is moved to a locked position.

9. The tub of claim 1 wherein the front edge of said door is slidably attached to said forward wall.

10. The tub of claim 9 wherein the front edge of said door is slidably attached to the forward wall by means of a tracking wheel attached to the top edge of said door, which tracking wheel is slidably movable along a horizontal track attached to said forward wall.

11. The tub of claim 10 wherein a drip cover covering said track is attached to said forward wall.

12. The tub of claim 1 wherein compressible gaskets are attached to the opening in said entrance wall.

13. The tub of claim 1 wherein said tub is rectangular in shape and has a back wall.

14. The tub of claim 13 wherein said back wall forms a backrest portion of the seat member.

15. The tub of claim 14 wherein said seat surface is continguous with the entrance wall.

* * * * *